US011756515B1

(12) United States Patent
Pereverzev

(10) Patent No.: US 11,756,515 B1
(45) Date of Patent: Sep. 12, 2023

(54) METHOD AND SYSTEM FOR GENERATING MUSICAL NOTATIONS FOR MUSICAL SCORE

(71) Applicant: MUSE CY LIMITED, Mesa Geitonia (CY)

(72) Inventor: Vasilij Pereverzev, Ghent (BE)

( * ) Notice: Subject to any disclaimer, the term of this patent is extended or adjusted under 35 U.S.C. 154(b) by 0 days.

(21) Appl. No.: 18/064,743

(22) Filed: Dec. 12, 2022

(51) Int. Cl.
*G10H 1/00* (2006.01)
*G10G 1/04* (2006.01)

(52) U.S. Cl.
CPC ..... *G10G 1/04* (2013.01); *G10H 1/0008* (2013.01); *G10H 1/0066* (2013.01); *G10H 2210/066* (2013.01); *G10H 2210/086* (2013.01); *G10H 2210/095* (2013.01); *G10H 2220/121* (2013.01)

(58) Field of Classification Search
CPC ..... G10H 1/0008; G10H 2210/066; G10H 1/0066; G10H 1/0025; G10H 2210/091; G10H 2220/015; G10H 2240/056; G10H 2240/131; G10H 2220/101; G10H 2210/111; G10H 2210/105; G10H 2210/051; G10H 1/0033; G10H 2240/311; G10H 2210/086; G10H 1/20; G10H 2210/081; G10H 2240/016; G10H 3/125; G10H 1/18; G10H 2220/091; G10H 2240/075; G10H 1/0091; G10H 2220/121; G10H 2230/031; G10H 2240/171; G10H 2230/041; G10H 2240/121; G10H 2250/00; G10H 7/006; G10H 7/08; G10H 2210/031
See application file for complete search history.

(56) References Cited

U.S. PATENT DOCUMENTS 10,460,712 B1 * 10/2019 Fayan ..... G10H 1/0033
10,964,299 B1 * 3/2021 Estes ..... G10H 1/0025
2006/0219089 A1 * 10/2006 Funaki ..... G10H 1/0008 84/611
2013/0319209 A1 * 12/2013 Good ..... G10H 1/18 84/483.2
2017/0084259 A1 * 3/2017 Watanabe ..... G10H 1/40
2020/0402488 A1 * 12/2020 Williams ..... G10H 1/0025
(Continued)

FOREIGN PATENT DOCUMENTS

EP 1026660 A1 * 8/2000 ..... G10H 1/0008
JP 2000267653 A * 9/2000 ..... G09B 15/04
(Continued)

*Primary Examiner* — Marlon T Fletcher
(74) *Attorney, Agent, or Firm* — RC Trademark Company

(57) ABSTRACT

Disclosed is a computer-implemented method and system for generating musical notations for a musical score. The method comprises receiving, via a first user interface, a musical note event of the musical score, processing, via a processing arrangement, the received musical note event of the musical score to determine one or more relevant music profile definitions therefor, defining, via the processing arrangement, one or more parameters to be associated with the received musical note event of the musical score based, at least in part, on the determined one or more relevant music profile definitions therefor and generating, via the processing arrangement, at least one notation output for the received musical note event of the musical score based on the defined one or more parameters associated therewith.

11 Claims, 5 Drawing Sheets

(56) References Cited

U.S. PATENT DOCUMENTS

| | | | | |
|---|---|---|---|---|
| 2022/0415291 | A1* | 12/2022 | Zuta | G10H 1/0066 |
| 2023/0032765 | A1* | 2/2023 | Plazak | G06F 3/03545 |

FOREIGN PATENT DOCUMENTS

| | | | | |
|---|---|---|---|---|
| WO | WO-03105122 | A1 * | 12/2003 | G10H 1/0008 |
| WO | WO-2004025306 | A1 * | 3/2004 | G10H 1/0025 |
| WO | WO-2017043228 | A1 * | 3/2017 | G09B 15/023 |

* cited by examiner

METHOD AND SYSTEM FOR GENERATING MUSICAL NOTATIONS FOR MUSICAL SCORE

TECHNICAL FIELD

This present disclosure generally relates to musical notation software. In particular, though not exclusively, the present disclosure relates to a method and to a system for generating musical notations for a musical score.

BACKGROUND

Technology has played a vital role in rapid development of various industries such as, media, entertainment, music, publishing industry, and other industries. Specifically, with the adoption of new technologies, conventional sheet music has evolved into a digital or paperless format and correspondingly, various sheet music providers have developed various software applications such as, for display, notation or playback of musical score data. Currently, major notation applications use a musical instrument digital interface (MIDI) protocol to provide the musical score notation and playback, wherein MIDI allows for simultaneous provision of multiple notated instructions for numerous instruments. Notably, there are many notated symbols and concepts that can be sufficiently described (in playback terms) using a well-chosen collection of MIDI events. However, there still exist many significant limitations to the said protocol, which severely hamper the playback potential of notation applications based on utilizing MIDI as their primary transmission mode for musical instructions to samplers.

Generally, for any user to record music performed on any musical instrument (such as, MIDI-enabled keyboard instrument), the user is required to employ a digital audio workstation (DAW) or a notation application. Herein, the DAW's may be operable to transcribe input the musical performances (or MIDI events) for provision or display as notations on a musical score. However, the output notations provided by the DAW's have significant inaccuracies and/or inconsistencies due to poor interpretation quality of the input MIDI events. In light of the aforementioned deficiencies with DAW's, notation applications are generally utilized owing to the better notated interpretation quality of MIDI performances. However, since MIDI does not support notated concepts (such as, staccato, slurs, trills, etc.), conventional notation applications are required to collect recorded MIDI events (such as, NoteOn, NoteOff, Pitch, Velocity, etc.) and accordingly apply their own rules (or interpretations) to determine the manner in which certain combinations of musical events and their proximity with each other may be represented as notation. Consequently, the output notations, via such conventional notation applications, are potentially imprecise or inaccurate and owing to such inaccuracies, requires significant amount of 'clean up' work before the input musical performances are made acceptable; i.e., from a general notation standpoint, wherein the resulting musical score may be considered 'playable'.

There have been various attempts to solve the aforementioned problems. However, still such solutions face numerous problems such as, but not limited to, the interpretation of articulations and other kinds of unique performance directions that cannot be handled by MIDI instructions are required to be added on a case-by-case basis. Further, since each notation application handles articulations and instrument definitions differently, the approach for how each application translates its unique set of definitions into a recognizable format differs for each application. Moreover, in cases where such solutions support unique playback for a notated symbol, the conventional solutions are forced to fall back on the limited capabilities of MIDI, with each arriving at their own unique method of providing a convincing-sounding performance. However, these fallback performances will not be understood meaningfully by any user (or new corner into music industry) from a notation point of view since the notated concept underpinning the MIDI performance cannot be discerned without dedicated support. Moreover, some of the existing notation applications enable users to customize various musical parameters for allowing relatively accurate interpretation of input musical performances. However, such customizations are problematic due to user-specific interpretations of various notated symbols that may differ depending on the style of musical performance (for example, jazz, classical, pop, etc.), period (for example, baroque, romantic, 20th century, etc.) and user-specific playing preferences. Alternatively stated, owing to the user-specific (or non-standard) interpretations and the style of the musical performance, such notations are inconsistent i.e., cannot be utilized universally and hampers the playback potential of such notation applications.

Therefore, in light of the foregoing discussion, there exists a need to overcome the aforementioned drawbacks and provide a user-friendly, flexible, accurate, dynamic, and virtually universal method and/or system for generating musical notations for a musical score.

SUMMARY OF THE INVENTION

A first aspect of the present disclosure provides a computer-implemented method for generating musical notations for a musical score. Throughout the present disclosure, the term "musical score" refers to a written (or printed) musical composition on a set of staves braced and/or barred together, wherein the musical score is represented using the generated musical notations for describing the parameters and/or elements thereof. The musical score may be composed for a part of a solo musical composition or for one or more parts of an ensemble composition. The term "musical notation" refers to visual representations of aurally perceived music, such as, played with instruments or sung by the human voice, via utilization of written, printed, or other symbols. Typically, any user producing musical scores such as, via any musical instrument, may require translation of the produced music in the form of musical notations and thus, may employ the computer implemented method to generate the required musical notations for any input music (i.e., musical note events), wherein the generated musical notations for the musical score are consistent, accurate and versatile in nature i.e., may be run or any platform or device. It will be appreciated that the method may employ any standard notational frameworks or employ a custom notational framework for generating the notations. For example, the musical notations may be based on Musical instrument digital interface (MIDI).

Additionally, the method may be configured to provide a flexible playback protocol for defining articulations and other notated symbols, which is rooted in musical notation, such that any user (such as, third party developers of music samplers) can be provided with appropriate context for developing unique playback interpretations. The method is also configured to allow provision of additional context that determines the playback for a given notated symbol. For example, a 'slur' mark placed over a notated sequence for the piano (indicating a phrase), could be given a unique definition due to the instrument being used, which would differ to the definition used if the same notation was specified for the guitar instead (which would indicate a 'hammer-on' performance)

In an embodiment, the musical notations generated via the method are MIDI-based notations. Typically, MIDI comprises a comprehensive list of pitch ranges and allows for multiple signals to be communicated via multiple channels, and enable simultaneous provision of multiple notated instructions for numerous instruments. Beneficially, MIDI has a ubiquitous presence across most music hardware (for example, keyboards, audio interfaces, etc.) and software (for example, DAW's, VST, audio unit plugins, etc.), which enables the method to receive and send complex messages to other applications, instruments and/or samplers and thereby provides versatility to the method. Moreover, MIDI has a sufficient resolution i.e., able to handle precise parameter adjustments in real-time, allowing the method to provide the user with a higher degree and/or granularity of control. Additionally, owing to the capability of communication of musical instructions (such as, duration, pitch, velocity, volume, etc.), MIDI allows the method for sufficiently replicating different types of musical performances implied by most symbols found in musical notations in a realistic manner.

In another embodiment, the received musical note event is a Musical Instrument Digital Interface (MIDI) note event comprising each of MIDI messages received in a time interval between a MIDI NoteOn and a MIDI NoteOff message in a single MIDI channel.

In an exemplary scenario of modern musical notation, there exists a staff (or stave) that consists of 5 parallel horizontal lines which acts as a framework upon which pitches are indicated by placing oval note-heads (i.e., crossing) on the staff lines, between the lines (i.e., in the spaces), or above and below the staff using small additional ledger lines. The musical notation is typically read from left to right; however, may be notated in a right-to-left manner as well. The pitch of the musical score (or a note thereof) may be indicated by the vertical position of the note-head within the staff, and can be modified by accidentals. The duration (note length or note value) may be indicated by the form of the note-head or with the addition of a note-stem plus beams or flags. A stemless hollow oval is a whole note or semibreve, a hollow rectangle or stemless hollow oval with one or two vertical lines on both sides is a double whole note or *breve*. A stemmed hollow oval is a half note or minim. Solid ovals always use stems, and can indicate quarter notes (crotchets) or, with added beams or flags, smaller subdivisions. However, despite such intricate notation standards or frameworks, there still exists a continuous need to develop additional symbols to increase the accuracy and quality of corresponding musical playback and as a result, improve the user experience.

The method comprises receiving, via a first user interface, a musical note event of the musical score. Alternatively stated, the first user interface may be configured for receiving the musical note event(s) (or simply, musical note event) of the musical score. For example, any user employing the method, may be able to enter the musical note event via the first user interface.

The term "user interface" as used herein refers to a point of interaction and/or communication with a user such as, for enabling access to the user and receiving musical data (such as, the musical note event) therefrom. The first user interface may be configured to receive the musical note event either directly from a device or instrument, or in-directly via another device, webpage, or an application configured to enable the user to enter the musical note event. Herein, the user interface may be configured to receive the user input i.e., the musical note event via one or more input modules for further processing thereof. In an example, the user interface may comprise one or more input modules such as, but not limited to, a text field, a checkbox, a list, a list box, a button, a radio button, a toggle, and the like, to enable the user to provide input (for example, to input the musical note event). Further, the term "note event" as used herein refers to a musical sound (i.e., musical data) entered by the user via the first user interface, wherein the musical note event may be representative of musical parameters such as, but not limited to, pitch, duration, pitch class, etc. required for generating the musical notations for the musical score. The note event may be a collection of one or more elements of a musical note event, one or more chords, or one or more chord progressions. It will be appreciated that the note event may be derived directly from any musical instrument, such as, keyboard, guitar, violin, drums, etc., or transferred upon recording in any conventional music format such as, via an external device or application, without any limitations.

The method further comprises processing, via a processing arrangement, the received musical note event of the musical score to determine one or more relevant music profile definitions therefor. Alternatively stated, the processing arrangement is configured to process the received musical note event to determine one or more relevant music profile definitions of the musical score. Typically, any musical note event may be defined or associated with various musical patterns and/or parameters that define the performance technique thereof, for example, a specific genre or style of music associated with the received musical note event, that allows the method to generate accurate notations for allowing realistic playback of the musical note event. Moreover, the one or more relevant music profile definitions are flexible or modifiable i.e., users can replace them with customized definitions based on the needs of the implementation, or add new music profile definitions therein. Notably, the one or more relevant music profile definitions that are modified or added by the user are automatically be translated into universally understood parameters for generating accurate musical notations of the musical score.

By default, the method comprises built-in general articulations profile for each instrument family (e.g., strings, percussions, keyboards, winds, chorus) that describe the performance technique thereof, including generic articulations (such as, staccato, tenuto, etc.). The term "music profile definitions" as used herein refers to a set of characteristic or features, associated with the musical note event, comprising contextual information related to the playback of the musical note event. The one or more relevant music profile definitions enable the method to define any context of the musical note event based on at least one of a specific genre, era, style, or composer. The relevant music profile may be based on the type of instrument used for recording the musical note event (for example, strings, percussions, keyboards, winds, chorus) that describe the performance technique thereof, including generic articulations (such as, staccato, tenuto, etc.) as well as instrument specific definitions as well as (such as, woodwinds & brass, strings, percussions, etc.). Alternatively stated, different type of instruments, composers and musical styles have different inherent configurations that makes the said composer, instrument, or style different or unique from others.

Herein, the method is configured to either automatically determine the one or more relevant music profile definitions based on the processed musical note event or enable a user to select the one or more relevant music profile definitions via the interface. Beneficially, the method enables customized and accurate playback of the musical note event based on the needs of the implementation i.e., the method enables recreation of any type of musical note event ranging from older eras, contemporary musical styles or composers to modern composition styles and composers in an accurate and realistic manner.

The term "processing arrangement" as used herein refers to refers to a structure and/or module that includes programmable and/or non-programmable components configured to store, process and/or share information and/or signals relating to the method for generating notations. The processing arrangement may be a controller having elements, such as a display, control buttons or joysticks, processors, memory and the like. Typically, the processing arrangement is operable to perform one or more operations for generating notations. In the present examples, the processing arrangement may include components such as memory, a processor, a network adapter and the like, to store, process and/or share information with other computing components, such as, the user interface, a user device, a remote server unit, a database arrangement. Optionally, the processing arrangement includes any arrangement of physical or virtual computational entities capable of enhancing information to perform various computational tasks. Further, it will be appreciated that the processing arrangement may be implemented as a hardware processor and/or plurality of hardware processors operating in a parallel or in a distributed architecture. Optionally, the processing arrangement is supplemented with additional computation system, such as neural networks, and hierarchical clusters of pseudo-analog variable state machines implementing artificial intelligence algorithms. Optionally, the processing arrangement is implemented as a computer program that provides various services (such as database service) to other devices, modules or apparatus. Optionally, the processing arrangement includes, but is not limited to, a microprocessor, a micro-controller, a complex instruction set computing (CISC) microprocessor, a reduced instruction set (RISC) microprocessor, a very long instruction word (VLIW) microprocessor, Field Programmable Gate Array (FPGA) or any other type of processing circuit, for example as aforementioned. Additionally, the processing arrangement may be arranged in various architectures for responding to and processing the instructions for generating the notations via the method.

Herein, the system elements may communicate with each other using a communication interface. The communication interface includes a medium (e.g., a communication channel) through which the system components communicate with each other. Examples of the communication interface include, but are not limited to, a communication channel in a computer cluster, a Local Area Communication channel (LAN), a cellular communication channel, a wireless sensor communication channel (WSN), a cloud communication channel, a Metropolitan Area Communication channel (MAN), and/or the Internet. Optionally, the communication interface comprises one or more of a wired connection, a wireless network, cellular networks such as 2G, 3G, 4G, 5G mobile networks, and a Zigbee connection.

In one or more embodiments, the one or more relevant music profile definitions comprise at least one of: a genre of the received musical note event, an instrument of the received musical note event, a composer of the received musical note event, a period profile of the received musical note event, a custom profile of the received musical note event. Typically, the determined relevant music profile definitions comprise at least one of the genre, instrument, composer, period (or era) of the received musical note event that enables the method to determine musical parameters associated with the received musical note event for enabling accurate playback thereof. The genre of the received musical note event includes, for example, Jazz, rock, contemporary, classical. The style of the received musical note event includes, for example, romantic style. Baroque, renaissance, or customized styles. The composers include, for example, Richard Wagner, Robert Schumann, Gustav Mahler, Johannes Brahms, Franz Liszt, and the like. Beneficially, selecting or choosing the style, genre, or composer of the received musical note event enables the method to prioritize certain defined (or custom) profiles based on the determined one or more music profile definitions and thereby enabling further processing thereof via the method.

In one or more embodiments, the method further comprises receiving, via a second user interface, at least one user-defined music profile definition for the musical score, wherein the one or more relevant music profile definitions for the received musical note event of the musical score are determined based on the received at least one user-defined music profile definition for the musical score. Typically, any user may input the at least one user-defined music profile definition for the musical score i.e., based on the needs of the implementation, the user may define user-defined custom music profile definitions that enable the method to identify the one or more relevant music profile definitions to thereby generate accurate notations for the musical score. Notably, the at least one user defined music profile definition is flexible or modifiable i.e., users can replace them with customized definitions based on the needs of the implementation, or add new music profile definitions therein. Herein, the at least one user-defined music profile definition is inputted by the user using the second user interface, for example, during recording of musical performances using any musical instrument (such as, a MIDI keyboard device), the user may select, from the second user interface (such as, from a list or checkbox), at least one of a predefined style (if any), period (if any) and/or any custom profile created by the user or obtained from a third-party source.

Beneficially, the at least one user-defined music profile definition allows the definition and/or creation of separate or individual profiles that can describe any context, including a specific genre, era or even composer. For example, a user may define a jazz individual profile that could specify sounds to produce a performance similar to that of a specific jazz ensemble or style. The term "user-defined profile definition" as used herein refers to a set of definitions of articulation patterns associated with supported instrument families for defining custom articulation profiles i.e., modifiable by a user and comprises information related to the playback of the musical note event. Herein, the second user interface may be configured to enable the user to define the individual profiles for each of the one or more articulation for the musical note event based on a requirement of the user, wherein the individual profiles are defined based on the genre, instrument, era and author of the musical note event to provide an accurate notation and corresponding realistic playback of the musical note event. The method may be configured to infer the one or more relevant music profiles based on the input (i.e., the at least one user-defined music profile definition) received from the user associated with the at least one user-defined music profile definition for the musical score. Moreover, beneficially, the user may utilize any custom profile definition to record the musical performance based on the needs of the implementation for enabling accurate and/or realistic playback of the musical score.

In an exemplary scenario, during definition of the at least one user-defined profile to suit their performance style, the user can also then set the profile as a general interpretation which can be used for automated playback. For example, if the user chooses a specific performance for a given notation output (or symbol) such as, a 'mordent' or a 'turn', the user can simultaneously specify the particular performance as a new default for interpretation of the notation output as used in a baroque era score. Beneficially, such an implementation allows the user to generate a musical score such as, created by a third party, and apply their custom at least one user-defined profile such that whenever a turn or mordent symbol appears, they are performed accordingly and thus, enabling users to alter the default playback of musical scores based on customized (or own) performance as a reference. Notably, such an implementation musical note event circumvents the requirement of exact correspondence with known notated events such as, available in conventional notation applications. In another example, musical performances can sound 'early', 'hung', 'offset', etc. without the notation output requiring to exactly correspond rhythmically to more accurately resemble (or reproduce) the relationship between notated musical scores and corresponding actual performances.

The method further comprises defining, via the processing arrangement, one or more parameters to be associated with the received musical note event of the musical score based, at least in part, on the determined one or more relevant music profile definitions therefor. Alternatively stated, the processing arrangement may be configured to define the one or more parameters based on the determined one or more relevant music profile definitions of the received musical note event. The term "parameter" as used herein refers to an aspect, element, or characteristic of the performance of the musical note event that enables analysis thereof. The one or more parameters are used to provide a context to accurately define the musical note event and each of the elements therein to enable the method to provide an accurate notation and further enable corresponding high-quality and precise musical score playbacks. For example, the one or more parameters include, pitch, timber, volume or loudness, duration, texture, velocity, time, amplitude, frequency, and the like. Typically, the one or more relevant music profile definitions further include the one or more parameters that any user can accept or modify to define the musical performance of the received musical note event. It will be appreciated that the music profile definitions may include both notational definitions and instrument definitions and wherein each relevant music profile definition may have one or more associated parameters without any limitations. Typically, each of the one or more relevant music profile definitions have the one or more parameters associated therewith i.e., each relevant music profile of the musical note event comprises respective one or more parameters (or characteristics) that define the notation and/or playback of the musical score. In an example, a specific music composer may have one or more unique performance parameters such as, pitch, that influences the notation and playback of the musical note event. In another example, a user may require a particular parameter such as, pitch or duration of the musical note event, based on the requirement of the implementation. Beneficially, the defined one or more parameters enable the method to customize or accept the one or more relevant profile definitions for providing granular control over the defined definitions and thereby, enabling generation of accurate and/or required notations for providing high quality and/or realistic playback of the musical score.

In one or more embodiments, in case two or more relevant music profile definitions are determined for the received musical note event of the musical score, the method comprises determining, via the processing arrangement, correspondingly, two or more parameters to be associated with the received musical note event of the musical score based on the two or more relevant music profile definitions therefor. Typically, in cases, wherein two or more relevant music profile definitions are determined for the received musical note event, the method is configured to determine two or more parameters associated with the musical note event of the musical score for enabling the method to generate the corresponding musical notations. Accordingly, the method may utilize the determined two or more parameters, associated with the musical note event, for generating the musical notations based thereon. Beneficially, the user is able to update or customize the relevant musical profile definitions via the two or more parameters based on the needs of the implementation for provision of accurate notations and/or playback of the musical score.

In one or more embodiments, the one or more parameters comprise at least one of an arrangement context, a pitch context, and an expression context. The one or more parameters comprise the arrangement context providing information about an event for the musical note event including at least one of a duration for the musical note event, a timestamp for the musical note event and a voice layer index for the musical note event. The term "arrangement context" as used herein refers to arrangement information about an event of the musical note event required for generating an accurate notation of the musical note event via the method. The arrangement context comprises at least one of a duration for the musical note event, a timestamp for the musical note event and a voice layer index for the musical note event. Typically, the musical note event comprises of a plurality of events and for each of the plurality of events, the one or more parameters are defined to provide a granular and precise definition of the entire musical note event. For example, the event may be one of a note event i.e., where an audible sound is present, or a rest event i.e., no audible sound or a pause is present. Thus, the arrangement context may be provided to accurately define each of the events of the musical note event via provision of the duration, the timestamp and the voice layer index of the musical note event.

In one or more embodiments, in the arrangement context, the duration for the musical note event indicates a time duration of the musical note event. The term "duration" refers to the time taken or the time duration for the entire musical note event to occur. It will be appreciated that the time duration may be provided for each event of the musical note event to provide a granular control via the method. The duration of the musical note event may be, for example, in milliseconds (ms), or second (s), or minutes (m), and whereas, the duration of each event may be, for example, in microseconds, ms, or s, to enable identification of the duration of each event (i.e., note event or rest event) of the musical note event to be notated and thereby played accordingly. For example, the duration for a first note event may be 2 seconds, whereas the duration of a first rest event may be 50 milliseconds, whereas the duration of the musical note event may be 20 seconds.

Further, in the arrangement context, the timestamp for the musical note event indicates an absolute position of each event of the musical note event. The "timestamp" as used herein refers to a sequence of characters or encoded information identifying when a certain event of the musical note event occurred (or occurs). In an example, the timestamp may be an absolute timestamp indicating date and time of day accurate to the milliseconds. In another example, the timestamp may be a relative timestamp based on an initiation of the musical note event, i.e., the timestamp may have any epoch, can be relative to any arbitrary time, such as the power-on time of a musical system, or to some arbitrary reference time.

Furthermore, in the arrangement context, the voice layer index for the musical note event provides a value from a range of indexes indicating a placement of the musical note event in a voice layer, or a rest in the voice layer. Typically, each musical note event may contain multiple voice layers, wherein the musical note events or rest events are placed simultaneously across the multiple voice layers to produce the final musical note event (or sound), and thus, a requirement of identification of the location of an event in the multiple musical layers of the musical note event may be developed for musical score notation and corresponding playback. Thus, to fulfil such a requirement, the arrangement context contains the voice layer index for the musical note event that provides a value from a range of indexes indicating the placement of the musical note event or the rest event in the voice layer. The term "voice layer index" refers to an index indicating placement of an event in a specific voice layer and may be associated with the process of sound layering. The voice layer index may contain a range of values from zero to three i.e., provides four distinct placement indexes, namely, 0, 1, 2, and 3. Beneficially, the voice layer index enables the method to explicitly exclude the musical note events or the rest events, from the areas of articulation or dynamics (which they do not belong to) to provide separate control over each of events of the musical note event and the articulation thereof allowing resolution of many musical corner cases.

In one or more embodiments, a pause as the musical note event may be represented as a RestEvent having the one or more parameters associated therewith, including the arrangement context with the duration, the timestamp and the voice layer index for the pause as the musical note event. Conventionally, MIDI based-solutions do not allow definition of pauses within the musical note event into notations and thus, to overcome the aforementioned problem, the method of the present disclosure allows for such pauses to be represented as the RestEvent having the one or more parameters associated therewith. The RestEvent may be associated with the one or more parameters and includes the arrangement context comprising at least the timestamp, the duration, and the voice layer index therein. For example, the arrangement context for a RestEvent may be: timestamp: 1 m, 10 s; duration: 5 s; and voice layer index:2.

Further, in the present method, the one or more parameters comprise a pitch context providing information about a pitch for the musical note event including at least one of a pitch class for the musical note event, an octave for the musical note event and a pitch curve for the musical note event. The term "pitch context" refers to information relating to the pitch of the musical note event allowing ordering of the musical note event on a scale (such as, a frequency scale). Herein, the pitch context includes at least the pitch class, the octave, and the pitch curve of the associated musical note event. Beneficially, the pitch context allows determination of the loudness levels and playback requirements of the musical note event for enabling an accurate and realistic musical score playback via the generated notations of the method.

In an embodiment, in the pitch context, the pitch class for the musical note event indicates a value from a range including C, C #, D, D #, E, F, F #, G, G #, A, A #, B for the musical note event. The term "pitch class" refers to a set of pitches that are octaves apart from each other. Alternatively stated, the pitch class contains the pitches of all sounds or musical note events that may be described via the specific pitch, for example, a pitch of any musical that may be referred to as F pitch, is collected together in the pitch class F. The pitch class indicates a value from a range of C, C #, D, D #, E, F, F #, G, G #, A, A #, B and allows a distinct and accurate classification of the pitch of the musical note event for accurate notation of the musical note event via the present method. Further, in the pitch context, the octave for the musical note event indicates an integer number representing an octave of the musical note event. The term "octave" as used herein refers to an interval between a first pitch and a second pitch having double the frequency as that of the first pitch. The octave may be represented by any whole number ranging from 0-17. For example, the octave may be one of 0, 1, 5, 10, 15, 17, etc. Furthermore, in the pitch context, the pitch curve for the musical note event indicates a container of points representing a change of the pitch of the musical note event over duration thereof. The term "pitch curve" refers to a graphical curve representative of a container of points or values of the pitch of the musical note event over a duration, wherein the pitch curve may be indicative of a change of the pitch of the musical note event over the duration. Typically, the pitch curve may be a straight-line indicative of a constant pitch over the duration, or a curved line (such as, a sine curve) indicative of the change in pitch over the duration.

Furthermore, in the present method, the one or more parameters comprise an expression context providing information about one or more articulations for the musical note event including at least one of an articulation map for the musical note event, a dynamic type for the musical note event and an expression curve for the musical note event. The term "expression context" as used herein refers to information related to articulations and dynamics of the musical note event i.e., information required to describe the articulations and applied to the musical note event over a time duration, wherein the expression context may be based on a correlation between an impact strength and a loudness level of the musical note event in both of the attack and release phases. Typically, the loudness of a musical note event depends on the force applied to a resonant material responsible for producing the sound, and thus, for enabling an accurate and realistic determination of corresponding playback data for the musical note event, the impact strength and the loudness level are analyzed and thereby utilized to provide the articulation map, the dynamic level, and the expression curve for the musical note event. Beneficially, the expression context enables the method to effectively generate accurate musical notations capable of enabling further provision of realistic and accurate musical score and playback thereof. The term "articulation" as used herein refers to a fundamental musical parameter that determines how a musical note event or other discrete event may be sounded. For example, tenuto, staccato, legato, etc. The one or more articulations primarily structure the musical note event (an event thereof) via describing its starting point, ending point, determining the length or duration of the musical note event and the shape of its attack and decay phases. Beneficially, the one or more articulations enable the user to modify the musical note event (or event thereof) i.e., modifying the timbre, dynamics, and pitch of the musical note event to produce stylistically or technically accurate musical notations to be generated via the present method.

Notably, the one or more articulations may be one of single-note articulations or multi-note articulations. In one or more embodiments, the one or more articulations comprise single-note articulations including one or more of: Standard, Staccato, Staccatissimo, Tenuto, Marcato, Accent, SoftAccent, LaissezVibrer, Subito, FadeIn, FadeOut, Harmonic, Mute, Open, Pizzicato, SnapPizzicato, RandomPizzicato, UpBow, DownBow, Detache, Martele, Jete, ColLegno, SulPont, SulTasto, GhostNote, CrossNote, CircleNote, TriangleNote, DiamondNote, Fall, QuickFall, Doit, Plop, Scoop, Bend, SlideOutDown, SlideOutUp, SlidelnAbove, SlidelnBelow, VolumeSwell, Distortion, Overdrive, Slap, Pop.

In one or more embodiments, the one or more articulations comprise multi-note articulations including one or more of: DiscreteGlissando, ContinuousGlissando, Legato, Pedal, Arpeggio, ArpeggioUp, ArpeggioDown, ArpeggioStraightUp, ArpeggioStraightDown, Vibrato, WideVibrato, MoltoVibrato, SenzaVibrato, Tremolo8th, Tremolo16th, Tremolo32nd, Tremolo64th, Trill, TrillBaroque, UpperMordent, LowerMordent, UpperMordentBaroque, LowerMordentBaroque, PrallMordent, MordentWithUpperPrefix, UpMordent, Down Mordent, Tremblement, UpPrall, PrallUp, PrallDown, LinePrall, Slide, Turn, InvertedTurn, PreAppoggiatura, PostAppoggiatura, Acciaccatura, TremoloBar.

In one or more embodiments, in the expression context, the articulation map for the musical note event provides a relative position as a percentage indicating an absolute position of the musical note event. The term "articulation map" refers to a list of all articulations applied to the musical note event over a time duration. Typically, the articulation map comprises at least one of the articulation type i.e., the type of articulation applied to (any event of) the musical note event, the relative position of each articulation applied to the musical note event i.e., a percentage indicative of distance from or to the musical note event, and the pitch ranges of the musical note event. For example, single note articulations applied to the musical note event can be described as: {type: "xyz", from: 0.0, to: 1.0}, wherein 0.0 is indicative of 0% or 'start' and 1.0 is indicative of 100% or end, accordingly. Further, in the expression context, the dynamic type for the musical note event indicates a type of dynamic applied over the duration of the musical note event. The dynamic type indicates meta-data about the dynamic levels applied over the duration of the musical note event and includes a value from an index range: {'pp' or pianissimo, 'p' or piano, 'mp' or mezzo piano, 'mf' or mezzo forte, 'f' or forte, If' or fortissimo, 'sfz' or sforzando}. It will be appreciated that other conventional or custom dynamic types may be utilized by the present method without any limitations. Furthermore, in the expression context, the expression curve for the musical note event indicates a container of points representing values of an action force associated with the musical note event. The term "expression curve" refers to a container of points representing a set of discrete values describing the action force on a resonant material with an accuracy time range measured in microseconds, wherein a higher action force is indicative of higher strength and loudness of the musical note event and vice-versa.

The method further comprises generating, via the processing arrangement, at least one notation output for the received musical note event of the musical score based on the defined one or more parameters associated therewith. Herein, the method is configured to generate at least one notation output for the received musical note event of the musical score based on the defined one or more parameters associated therewith. The term "notation output" as used herein refers to a musical notation of the musical note event entered by the user and thereby generated via the processing arrangement. In an example, the at least one notation output is a notated symbol for the received musical note event. In another example, the notation output may a MIDI-based notation output corresponding to the input musical note event and based on the one or more parameters associated therewith. In another example, the notation output may a user-defined notation output corresponding to the entered musical note event and based on the one or more parameters associated therewith. Herein, the method is configured to reference (or compare) the musical note event for enabling comparison therefrom, and based on such referencing, the method is configured to generate the at least one notation output. The present method is customizable i.e., allows for numerous alternate interpretations of notation (including context), wherein a user may be able to precisely specify the manner in which the musical performance of the musical note event is to be interpreted, and simultaneously bypassing the need for understanding (or interpretation) and updation of highly abstract and technical performance parameters. Beneficially, the method is configured to generate accurate notations based on the defined one or more parameters for enabling realistic playback of the musical score in an efficient and user-friendly manner.

In one or more embodiments, the method further comprises translating the notation output into a universal notation. Typically, translation of the notation output into the universal notation comprises converting the one or more parameters into the universal parameters comprises splitting a musical note event into two or more channel message events, wherein each channel message event comprises at least one of a note on event or a note off event and determining a channel information for each of the two or more channel message events based on the one or more parameters. The term "channel information" refers to information related to each channel of two or more channel events of the musical note event. In an embodiment, the channel information comprises at least one of a group value, a channel value determined based on the instrument type, a note number determined based on the pitch context, and a velocity determined based on the arrangement context, associated with each channel message event. Herein, the received musical note event is matched or referenced via pairs of MIDI NoteON and MIDI NoteOff messages, wherein all Channel Voice Messages (i.e., MIDI-CC along with Note On/Off messages, Velocity, Aftertouch, Pitch Bend and Program change messages) received in the time-interval between MIDI NoteOn and MIDI NoteOff messages via the same MIDI-channel are interpreted as part of the single received musical note event. Further, the difference between MIDI NoteOn and MIDI NoteOff is determined based on the provided arrangement context of the one or more parameters, wherein the duration (in the arrangement context) is utilized to translate the note number of NoteOn and/or NoteOff messages into universal pitch context, wherein the pitch context comprises at least the pitch Class and the octave thereof. Further, based on the translated pitch context, the method is configured to generated a pitch curve using the channel voice messages (or the pitch bend messages therein) and an expression curve using the MIDI NoteOn and/or NoteOff velocity values and MIDI After-Touch messages (if given) based the following formula:

$$A = \frac{V}{0.5 * T};$$

wherein, 'A' refers to resulting approximate amplitude value of an attack phase, V: refers to MIDI velocity, and "T" refers to duration calculated from the arrangement context. Herein, the determined amplitude value indicates or represents the dynamic level of the musical not event. Furthermore, upon determining the one or more parameters associated with the musical note event, the method is further configured to analyze the determined note events and match (or reference) them with the one or more relevant musical profile definitions being used.

As discussed, in case two or more relevant music profile definitions are determined for the received musical note event of the musical score, the method comprises determining, via the processing arrangement, correspondingly, two or more parameters to be associated with the received musical note event of the musical score based on the two or more relevant music profile definitions therefor. In such case, the method further comprises generating, via the processing arrangement, correspondingly, two or more notation outputs for the received musical note event of the musical score based on the determined two or more parameters associated therewith, receiving, via the first user interface, selection of one of the generated two or more notation outputs for the received musical note event of the musical score and generating, via the processing arrangement, a notation output for the received musical note event of the musical score based on the selected one of the generated two or more notation outputs therefor. Typically, in cases wherein two or more notation outputs (corresponding to the two or more parameters) are generated for the received musical note event, the method is further configured to select (such as, via a user or automatically) from the generated two or more notation outputs of the implementation such that the selected notation output may be implemented for generating the musical score associated therewith.

In one or more embodiments, the method further comprises receiving, via the first user interface, a command to implement the selected one of the generated two or more notation outputs for the received musical note event of the musical score for defining a notation output for entirety of the musical score. Upon selecting one of the generated two or more notation outputs, the method is configured to receive a command such as, from the user, to implement the selected notation output for defining the notation output for the entire musical score. The "command" refers to a command signal or an input, such as, from a user, indicative of implementing the selected notation output for generating the notation output for the entirety of the musical score.

Additionally, in or more embodiments, the method further comprises determining, via the processing arrangement, one or more parameters to be associated with musical note events of the musical score complementary to one or more parameters corresponding to the selected one of the generated two or more notation outputs for the received musical note event of the musical score, and generating, via the processing arrangement, the notation output for entirety of the musical score based on the determined one or more parameters to be associated with musical note events of the musical score. That is, upon generated the notation output for the entire musical score, the user may be configured to update the one or more parameters associated with the relevant one or more music profile definitions or add one or more parameters complementary to the defined one or more parameters.

The present disclosure also relates to a system as described above. Various embodiments and variants disclosed above, with respect to the aforementioned first aspect, apply mutatis mutandis to the system.

A second aspect of the present disclosure provides a system for generating musical notations for a musical score. The system comprises a first user interface configured to receive a musical note event of the musical score and a processing arrangement.

Herein, upon receiving the musical note event, the processing arrangement is configured to process the received musical note event of the musical score to determine one or more relevant music profile definitions therefor. Upon determining the one or more relevant music profile definitions, the processing arrangement is further configured to define one or more parameters to be associated with the received musical note event of the musical score based, at least in part, on the determined one or more relevant music profile definitions and based on which, the processing arrangement is further configured to generate at least one notation output for the received musical note event of the musical score.

In one or more embodiments, the system further comprises a second user interface configured to receive at least one user-defined music profile definition for the musical score, wherein the one or more relevant music profile definitions for the received musical note event of the musical score are determined, via the processing arrangement, based on the received at least one user-defined music profile definition for the musical score.

In one or more embodiments, in case of two or more relevant music profile definitions been determined for the received musical note event of the musical score, the processing arrangement is further configured to determine, correspondingly, two or more parameters to be associated with the received musical note event of the musical score based on the two or more relevant music profile definitions therefor. Further, the processing is configured to generate, correspondingly, two or more notation outputs for the received musical note event of the musical score based on the determined two or more parameters associated therewith. Furthermore, the processing arrangement is configured to receive, via the first user interface, selection of one of the generated two or more notation outputs for the received musical note event of the musical score and generate a notation output for the received musical note event of the musical score based on the selected one of the generated two or more notation outputs therefor.

In one or more embodiments, the processing arrangement is further configured to receive, via the first user interface, a command to implement the selected one of the generated two or more notation outputs for the received musical note event of the musical score for defining a notation output for entirety of the musical score. The command acts as an initiation command signal to the processing arrangement to determine one or more parameters to be associated with musical note events of the musical score complementary to one or more parameters corresponding to the selected one of the generated two or more notation outputs for the received musical note event of the musical score and based on the selected notation output, generate the notation output for entirety of the musical score.

In one or more embodiments, the one or more relevant music profile definitions comprise at least one of: a genre of the received musical note event, an instrument of the received musical note event, a composer of the received musical note event, a period profile of the received musical note event, a custom profile of the received musical note event.

The present disclosure also provides a computer-readable storage medium comprising instructions which, when executed by a computer, cause the computer to carry out the steps of the method for generating notations. Examples of implementation of the non-transitory computer-readable storage medium include, but is not limited to, Electrically Erasable Programmable Read-Only Memory (EEPROM), Random Access Memory (RAM), Read Only Memory (ROM), Hard Disk Drive (HDD), Flash memory, a Secure Digital (SD) card, Solid-State Drive (SSD), a computer readable storage medium, and/or CPU cache memory. A computer readable storage medium for providing a non-transient memory may include, but is not limited to, an electronic storage device, a magnetic storage device, an optical storage device, an electromagnetic storage device, a semiconductor storage device, or any suitable combination of the foregoing.

Throughout the description and claims of this specification, the words "comprise" and "contain" and variations of the words, for example "comprising" and "comprises", mean "including but not limited to", and do not exclude other components, integers or steps. Moreover, the singular encompasses the plural unless the context otherwise requires: in particular, where the indefinite article is used, the specification is to be understood as contemplating plurality as well as singularity, unless the context requires otherwise.

Preferred features of each aspect of the present disclosure may be as described in connection with any of the other aspects. Within the scope of this application, it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible.

BRIEF DESCRIPTION OF THE DRAWINGS

One or more embodiments of the present disclosure will now be described, by way of example only, with reference to the following diagrams wherein.

DETAILED DESCRIPTION OF THE DRAWINGS

Figure 1:
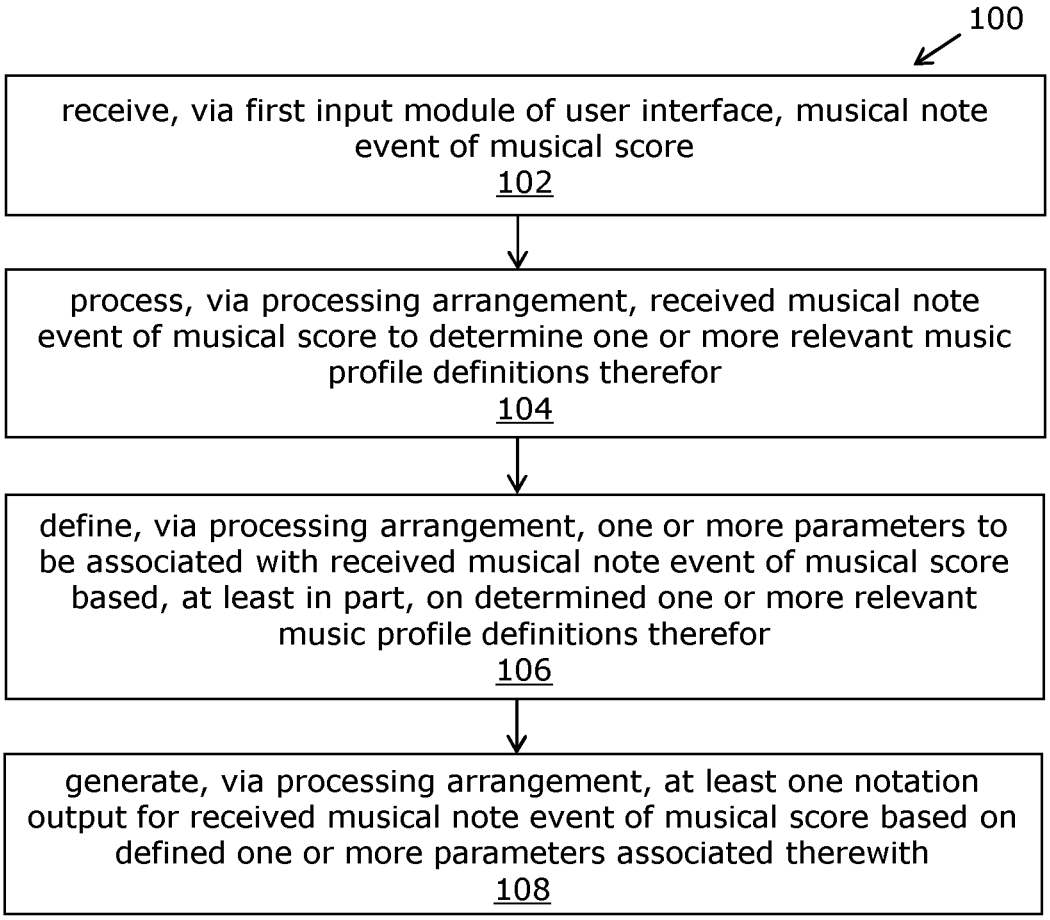
FIG. 1 is an illustration of a flowchart listing steps involved in a computer-implemented method for generating notations, in accordance with an embodiment of the present disclosure.

Referring to FIG. 1, illustrated is a flowchart listing steps involved in a computer-implemented method 100 for generating musical notations for a musical score, in accordance with an embodiment of the present disclosure. As shown, the method 100 comprising steps 102, 104, and 106. At a step 102, the method 100 comprises receiving, via a first user interface, a musical note event of the musical score. The musical note event(s) are entered by the user via the first user interface configured to allow the user to enter the musical note event of the musical score to be translated or notated by the method 100. At a step 104, the method 100 further comprises processing, via a processing arrangement, the received musical note event of the musical score to determine one or more relevant music profile definitions therefor. The processing arrangement is configured to determine the one or more one or more relevant music profile definitions via processing of the received musical note event of the musical score. At a step 106, the method further comprises defining, via the processing arrangement, one or more parameters to be associated with the received musical note event of the musical score based, at least in part, on the determined one or more relevant music profile definitions therefor. The processing arrangement is configured to define the one or more parameters to be associated with the musical event based on at least the determined one or more relevant music profile definitions for enabling further processing thereof. And, at a step 108, the method further comprises generating, via the processing arrangement, at least one notation output for the received musical note event of the musical score based on the defined one or more parameters associated therewith. The processing arrangement is further configured to generate the at least one notation output for the received musical note event based on the defined one or more parameters for generating the musical notations for the musical score.

Figure 2:
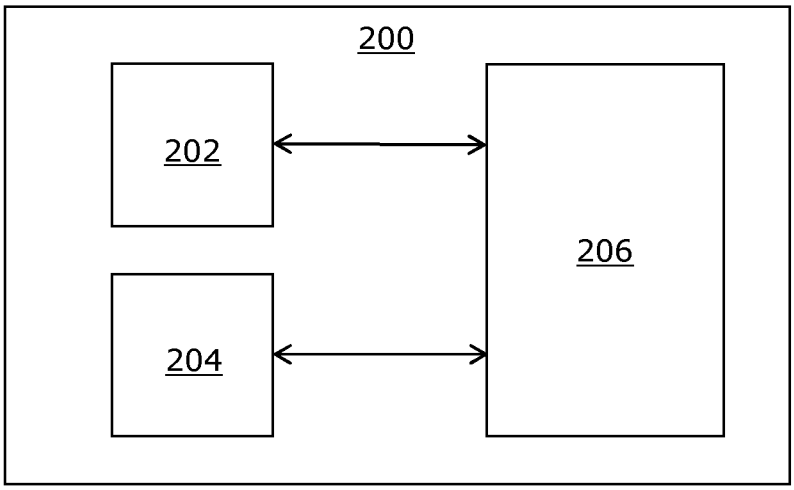
FIG. 2 is an illustration of a block diagram of a system for generating notations, in accordance with another embodiment of the present disclosure.

Referring to FIG. 2, illustrated is a block diagram of a system 200 for generating musical notations for a musical score, in accordance with another embodiment of the present disclosure. As shown, the system 200 comprises a first user interface 202 configured to receive a musical note event of the musical score and a second user interface 204 configured to receive at least one user-defined music profile definition for the musical score and a processing arrangement 206 configured to process the received musical note event of the musical score to determine one or more relevant music profile definitions therefor. The processing arrangement 206 is further configured to define one or more parameters to be associated with the received musical note event of the musical score based, at least in part, on the determined one or more relevant music profile definitions therefor; and generate at least one notation output for the received musical note event of the musical score based on the defined one or more parameters associated therewith.

Figure 3:
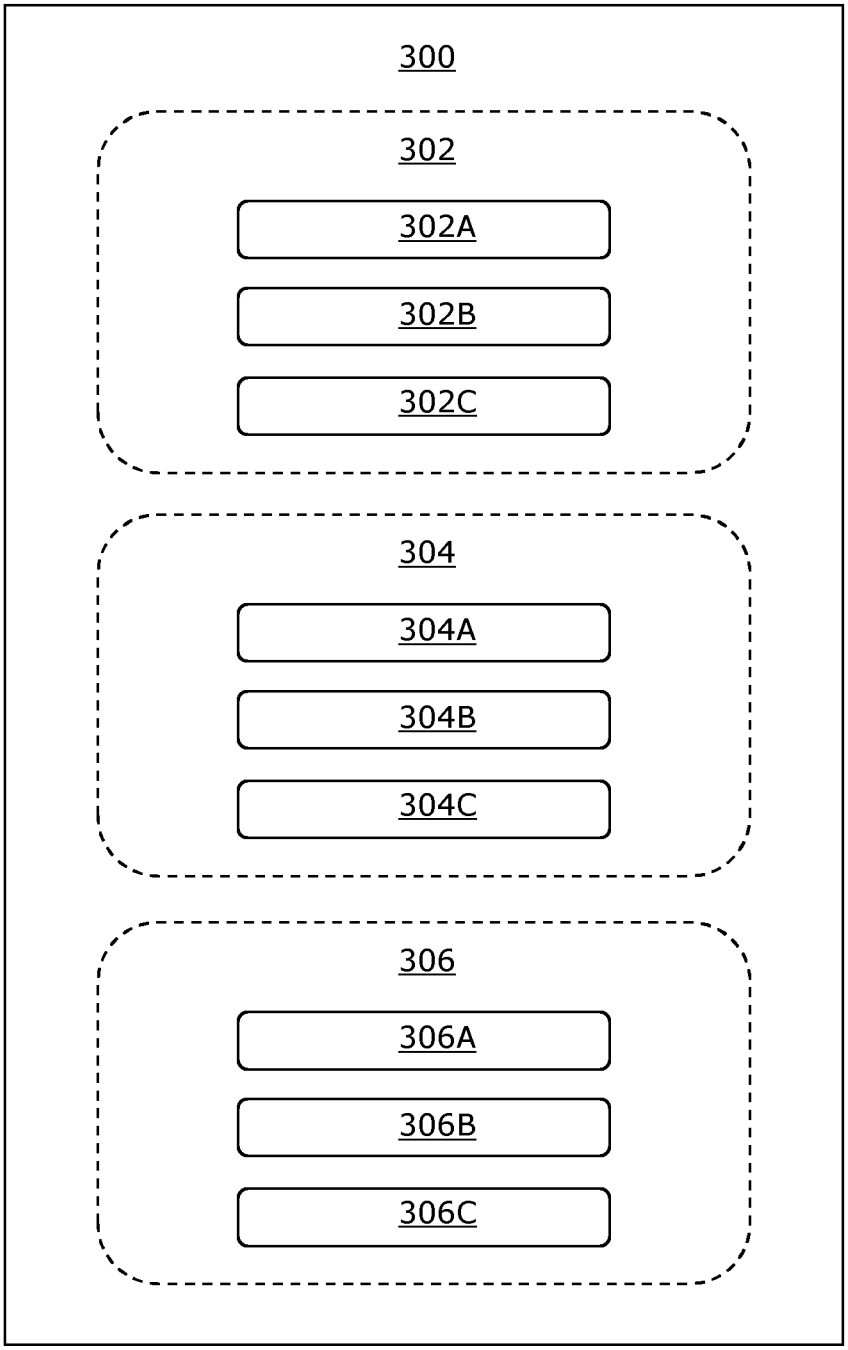
FIG. 3 is an illustration of an exemplary depiction of a musical note event being represented using one or more parameters thereof, in accordance with an embodiment of the present disclosure.

Referring to FIG. 3, illustrated is an exemplary depiction of a musical note event represented using one or more parameters 300 thereof, in accordance with one or more embodiments of the present disclosure. As shown, the exemplary musical note event is depicted using the one or more parameters 300 added by the user via the second user interface 204 i.e., the musical note event is translated using the one or more parameters 300 for further processing and analysis thereof. Herein, the one or more parameters 300 comprises at least an arrangement context 302, wherein the arrangement context 302 comprises a timestamp 302A, a duration 302B and a voice layer index 302C. Further, the one or more parameters 300 comprises a pitch context 304, wherein the pitch context 304 comprises a pitch class 304A, an octave 304B, and a pitch curve 304C. Furthermore, the one or more parameters 300 comprises an expression context 306, wherein the expression context 306 comprises an articulation map 306A, a dynamic type 306B, and an expression curve 306C. Collectively, the arrangement context 302, the pitch context 304, the expression context 306 enable the method 100 or the system 200 to generate accurate and effective notations.

Figure 4:
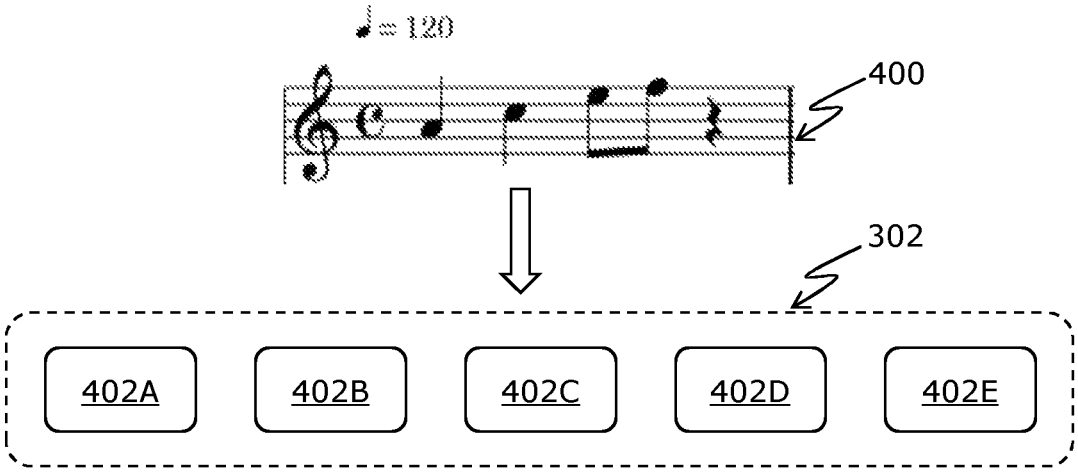
FIG. 4 is an exemplary depiction of a musical note event being translated into an arrangement context, in accordance with an embodiment of the present disclosure.

Referring to FIG. 4, illustrated is an exemplary depiction of a musical note event 400 being translated into the arrangement context 302, in accordance with an embodiment of the present disclosure. As shown, the musical note event 400 comprises a stave and five distinct events or notes that are required to be translated into corresponding arrangement context i.e., the five distinct events of the musical note event 400 are represented by the arrangement context 302 further comprising inherent arrangement contexts 402A to 402E. The first musical note event is represented as a first arrangement context 402A comprising a timestamp=0 s, a duration=500 ms, and a voice layer index=0. The second musical note event is represented as a second arrangement context 402B comprising a timestamp=500 ms, a duration=500 ms, and a voice layer index=0. The third musical note event is represented as a third arrangement context 402C comprising a timestamp=1000 ms, a duration=250 ms, and a voice layer index=0. The fourth musical note event is represented as a fourth arrangement context 402D comprising a timestamp=1250 s, a duration=250 ms, and a voice layer index=0. The fifth musical note event is represented as a fifth arrangement context 402A comprising a timestamp=0 s, a duration=500 ms, and a voice layer index=0.

Figure 5:
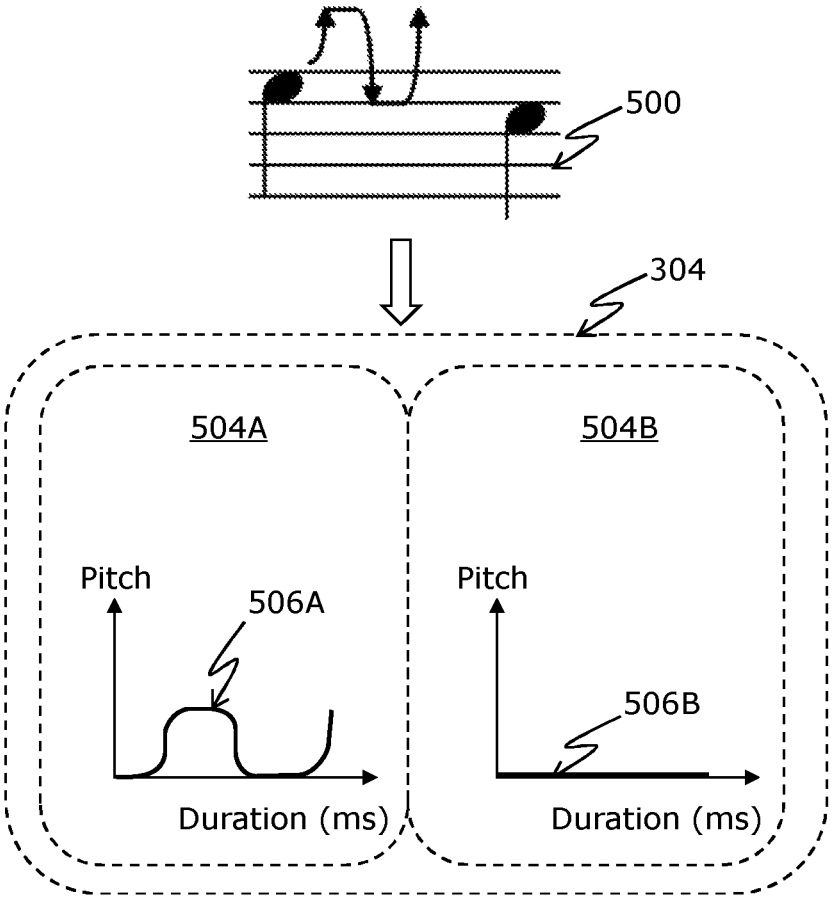
FIG. 5 is an exemplary depiction of a musical note event being translated into a pitch context, in accordance with an embodiment of the present disclosure.

Referring to FIG. 5, illustrated is an exemplary depiction of a musical note event 500 being translated into the pitch context 304, in accordance with an embodiment of the present disclosure. As shown, the musical note event 500 comprises two distinct events or notes that are required to be translated into corresponding pitch context i.e., the two distinct events of the musical note event 500 are represented by the pitch contexts 304 further comprising inherent pitch contexts 504A and 504B. The first musical note event is represented by the first pitch context 504A, wherein the first pitch context 504A comprises the pitch class=E, the octave=5, and the pitch curve 506A. The second musical note event is represented by the second pitch context 504B, wherein the second pitch context 504B comprises the pitch class=C, the octave=5, and the pitch curve 506B.

Figure 6A:
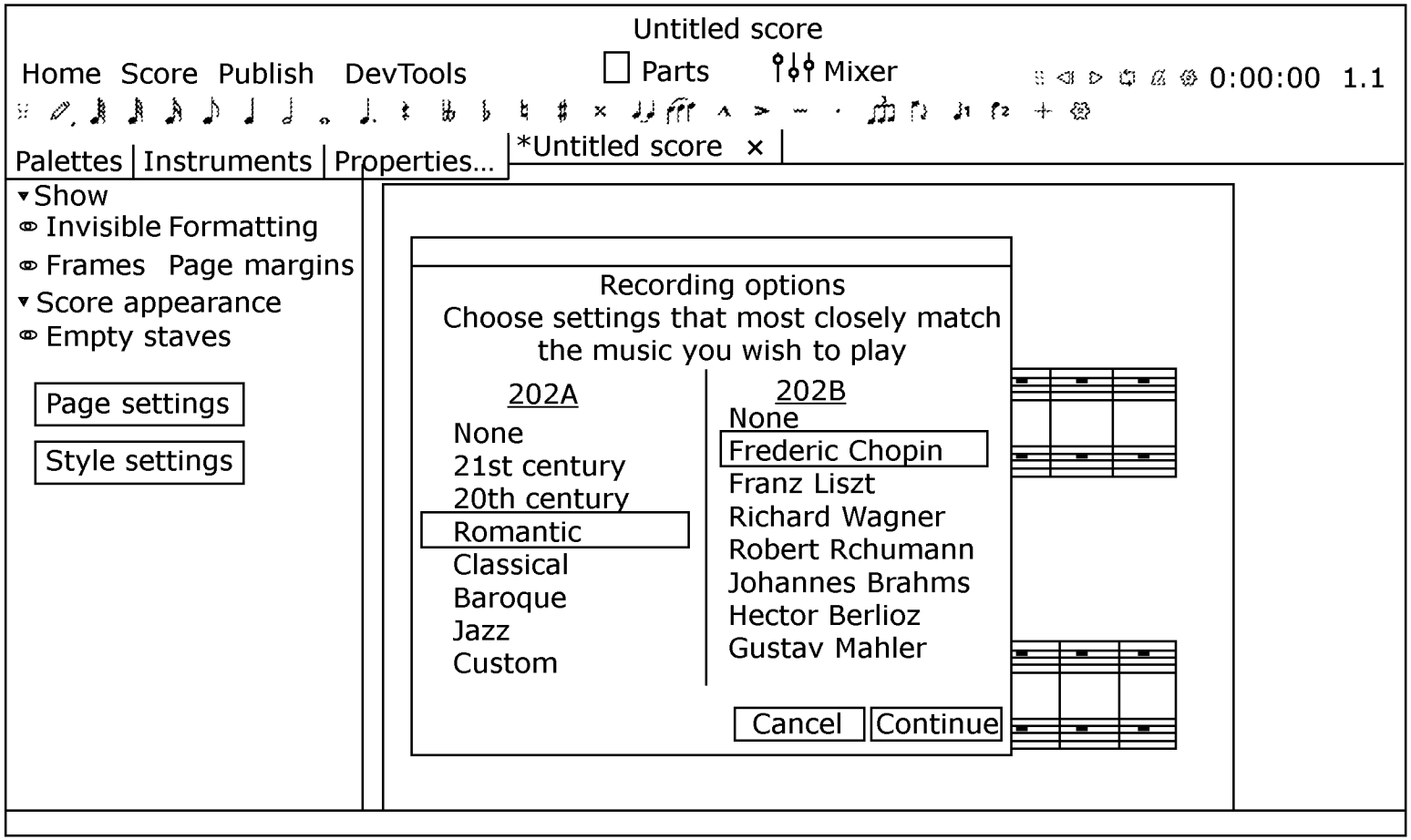
FIG. 6A is an exemplary illustration of a first user interface, in accordance with an embodiment of the present disclosure.

Referring to FIG. 6A, illustrated is an exemplary illustration of the first user interface 202, in accordance with an embodiment of the present disclosure. As shown, the first user interface 202 comprises two lists i.e., a first list 202A for different musical styles and a second list 202B for different composers (of various eras or styles). Herein, the first user interface 202 is configured to receive a musical note event of the musical score for processing, via the processing arrangement 206, to determine one or more relevant music profile definitions therefor. As shown, the user selects "Romantic" as style from the first list 202A and "Frederic Chopin" as composer from the second list 202B of the first user interface 202. Correspondingly, based on the selected one or more relevant profile definitions, the one or more parameters 300 associated therewith for generating the musical notations of the musical score may be determined.

Figure 6B:
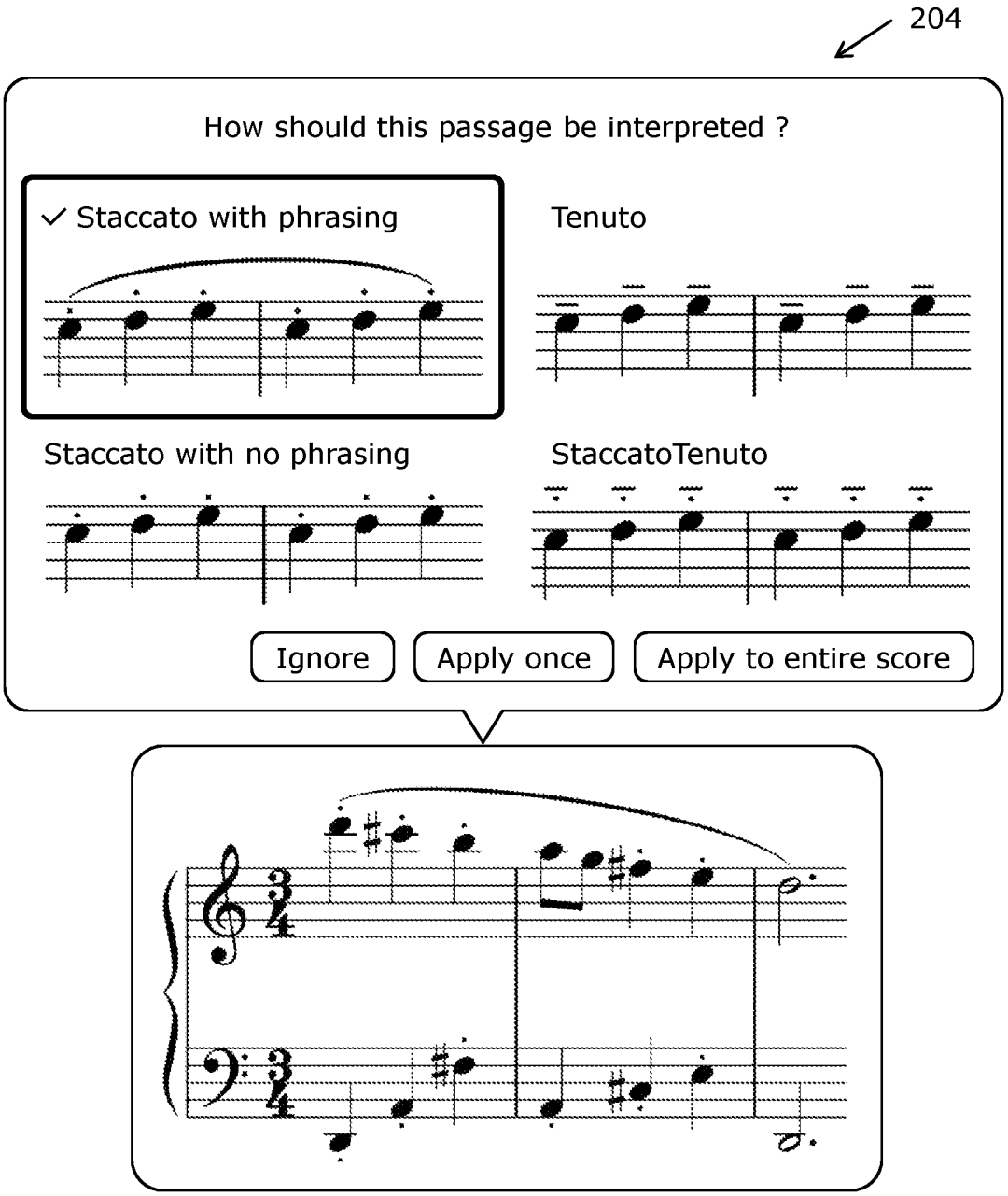
FIG. 6B is an exemplary illustration of a second user interface, in accordance with an embodiment of the present disclosure.

Referring to FIG. 6B, illustrated is a second user interface 204, in accordance with one or more embodiments of the present disclosure. As shown, the second user interface 204 is configured to enable the user to select a particular performance style (or definition) for the received musical note event, wherein the selected performance style may be selected either on the received musical note event or the entire musical score generated via the method 100 or system 200. Alternatively stated, after recording of a musical performance, wherein the at least one user-defined profile matches with one or more relevant profiles (which are adjusted for the style and instrument in question), the user is asked to specify the manner in which certain aspects of the musical performance should are to be interpreted. Herein, the second user interface 204 is configured to receive, via the 202, at least one user-defined music profile definition for the musical score, wherein the one or more relevant music profile definitions for the received musical note event of the musical score are determined, via the processing arrangement, based on the received at least one user-defined music profile definition for the musical score. Herein, the user may select or input the user-defined music profile definition based on which the one or more relevant music profile definitions may be determined for further generating the musical notations for the musical score.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A computer implemented method for generating musical notations for a musical score, the method comprising:

receiving, via a first user interface, a musical note event of the musical score;

processing, via a processing arrangement, the received musical note event of the musical score to determine one or more relevant music profile definitions therefor;

defining, via the processing arrangement, one or more parameters to be associated with the received musical note event of the musical score based, at least in part, on the determined one or more relevant music profile definitions therefor; and generating, via the processing arrangement, at least one notation output for the received musical note event of the musical score based on the defined one or more parameters associated therewith, wherein in case two or more relevant music profile definitions are determined for the received musical note event of the musical score, the method comprising:

determining, via the processing arrangement, correspondingly, two or more parameters to be associated with the received musical note event of the musical score based on the two or more relevant music profile definitions therefor;

generating, via the processing arrangement, correspondingly, two or more notation outputs for the received musical note event of the musical score based on the determined two or more parameters associated therewith;

receiving, via the user interface, selection of one of the generated two or more notation outputs for the received musical note event of the musical score; and generating, via the processing arrangement, a notation output for the received musical note event of the musical score based on the selected one of the generated two or more notation outputs therefor; wherein the method further comprising:

receiving, via a second user interface, a command to implement the selected one of the generated two or more notation outputs for the received musical note event of the musical score for defining a notation output for entirety of the musical score;

determining, via the processing arrangement, one or more parameters to be associated with musical note events of the musical score complementary to one or more parameters corresponding to the selected one of the generated two or more notation outputs for the received musical note event of the musical score; and generating, via the processing arrangement, the notation output for entirety of the musical score based on the determined one or more parameters to be associated with musical note events of the musical score.

2. The method according to claim 1, further comprising receiving, via the second user interface, at least one user-defined music profile definition for the musical score, wherein the one or more relevant music profile definitions for the received musical note event of the musical score are determined based on the received at least one user-defined music profile definition for the musical score.

3. The method according to claim 1, wherein the one or more relevant music profile definitions comprise at least one of: a genre of the received musical note event, an instrument of the received musical note event, a composer of the received musical note event, a period profile of the received musical note event, a custom profile of the received musical note event.

4. The method according to claim 1, wherein the one or more parameters comprise at least one of:

an arrangement context providing information about the musical note event including at least one of a duration for the musical note event, a timestamp for the musical note event and a voice layer index for the musical note event, a pitch context providing information about a pitch for the musical note event including at least one of a pitch class for the musical note event, an octave for the musical note event and a pitch curve for the musical note event, and an expression context providing information about one or more articulations for the musical note event including at least one of an articulation map for the musical note event, a dynamic type for the musical note event and an expression curve for the musical note event.

5. The method according to claim 4, wherein, in the arrangement context, the duration for the musical note event indicates a time duration of the musical note event, the timestamp for the musical note event indicates an absolute position of the musical note event, and the voice layer index for the musical note event provides a value from a range of indexes indicating a placement of the musical note event in a voice layer, or a rest in the voice layer.

6. The method according to claim 4, wherein, in the pitch context, the pitch class for the musical note event indicates a value from a range including C, C #, D, D #, E, F, F #, G, G #, A, A #, B for the musical note event, the octave for the musical note event indicates an integer number representing an octave of the musical note event, and the pitch curve for the musical note event indicates a container of points representing a change of the pitch of the musical note event over duration thereof.

7. The method according to claim 4, wherein, in the expression context, the articulation map for the musical note event provides a relative position as a percentage indicating an absolute position of the musical note event, the dynamic type for the musical note event indicates a type of dynamic applied over the duration of the musical note event, and the expression curve for the musical note event indicates a container of points representing values of an action force associated with the musical note event.

8. The method according to claim 1, wherein the received musical note event is a Musical Instrument Digital Interface (MIDI) note event comprising each of MIDI messages received in a time interval between a MIDI NoteOn and a MIDI NoteOff message in a single MIDI channel.

9. A system for generating musical notations for a musical score, the system comprising:

a first user interface configured to receive a musical note event of the musical score; and a processing arrangement configured to:

process the received musical note event of the musical score to determine one or more relevant music profile definitions therefor;

define one or more parameters to be associated with the received musical note event of the musical score based, at least in part, on the determined one or more relevant music profile definitions therefor; and generate at least one notation output for the received musical note event of the musical score based on the defined one or more parameters associated therewith, wherein in case of two or more relevant music profile definitions been determined for the received musical note event of the musical score, the processing arrangement is further configured to:

determine, correspondingly, two or more parameters to be associated with the received musical note event of the musical score based on the two or more relevant music profile definitions therefor;

generate, correspondingly, two or more notation outputs for the received musical note event of the musical score based on the determined two or more parameters associated therewith;

receive, via the second user interface, selection of one of the generated two or more notation outputs for the received musical note event of the musical score; and generate a notation output for the received musical note event of the musical score based on the selected one of the generated two or more notation outputs therefor;

wherein the processing arrangement is further configured to:

receive, via the second user interface, a command to implement the selected one of the generated two or more notation outputs for the received musical note event of the musical score for defining a notation output for entirety of the musical score;

determine one or more parameters to be associated with musical note events of the musical score complementary to one or more parameters corresponding to the selected one of the generated two or more notation outputs for the received musical note event of the musical score;

generate the notation output for entirety of the musical score based on the determined one or more parameters to be associated with musical note events of the musical score.

10. The system according to claim 9, further comprising the second user interface configured to receive at least one user-defined music profile definition for the musical score, wherein the one or more relevant music profile definitions for the received musical note event of the musical score are determined, via the processing arrangement, based on the received at least one user-defined music profile definition for the musical score.

11. The system according to claim 9, wherein the one or more relevant music profile definitions comprise at least one of: a genre of the received musical note event, an instrument of the received musical note event, a composer of the received musical note event, a period profile of the received musical note event, a custom profile of the received musical note event.

* * * * *